United States Patent [19]

Haertl

[11] Patent Number: 4,716,985

[45] Date of Patent: Jan. 5, 1988

[54] IN-THE-EAR HEARING AID

[75] Inventor: Christof Haertl, Neunkirchen, Fed. Rep. of Germany

[73] Assignee: Siemens Aktiengesellschaft, Berlin and Munich, Fed. Rep. of Germany

[21] Appl. No.: 44,727

[22] Filed: May 1, 1987

[30] Foreign Application Priority Data

May 16, 1986 [DE] Fed. Rep. of Germany ..... 3616558
May 16, 1986 [DE] Fed. Rep. of Germany ..... 3616557

[51] Int. Cl.[4] ..... H04R 25/02

[52] U.S. Cl. ..... 181/130; 181/135; 381/68.6; 381/69

[58] Field of Search ..... 181/130, 132, 135; 381/68.5, 68.6, 68.7, 69

[56] References Cited

U.S. PATENT DOCUMENTS 3,448,224 6/1969 Giller .
3,975,599 8/1976 Johanson ..... 381/153 X
4,532,649 7/1985 Bellafiore ..... 381/69
4,548,082 10/1985 Engebreston et al. ..... 73/585

FOREIGN PATENT DOCUMENTS

OS 1487272 3/1969 Fed. Rep. of Germany .
1117245 6/1968 United Kingdom .

OTHER PUBLICATIONS

"Anthropometric Manikin for Acoustic Research", M. D. Burkhard and R. M. Sachs, J. P. Acoust. SOC. AM. vol. 58, No. 1 7/75, pp. 214–222.

"Die Richtcharakteristik des Ohres, Von W. Schirmer, Mitteilung aus dem Institut fur Elektro. und Bauakustik der Technischen Universitat Dresden, 27, Nov. 1961, pp. 39–48.

*Primary Examiner*—B. R. Fuller

[57] ABSTRACT

The housing of the hearing aid comprises a distal, bead-like head part having a planar face on which an arched face plate is seated and comprises a proximal, thinner tail part. The angle $\alpha$ between the normal of the planar face and the longitudinal axis of the tail part lies in the range of 135° through 142°, preferably at 140°, in a first longitudinal plane through the housing and a corresponding angle $\beta$ in a second, perpendicular longitudinal plane through the housing lies in the range from 12° through 17°, preferably at 14°.

17 Claims, 5 Drawing Figures

IN-THE-EAR HEARING AID

BACKGROUND OF THE INVENTION

1. Field of the Invention

The invention is directed to an in-the-ear hearing aid having a pear-shaped housing that encompasses a distal, bead-like head part having a planar face on which a face plate is seated and encompass a proximal, thinner tail part.

2. Description of the Prior Art

In hearing aid technology it is known to form a shell of moldable material to conform to the auditory canal of the hearing aid user. It is also known to insert a housing containing the electronic components of the hearing aid inside the shell. Such a hearing aid is known, for example, from Great Britain Pat. No. 2 070 890.

In hearing aids which are small enough so as to be substantially introduced into the auditory canal, facilitation of such insertion is aided as much by the structure of the hearing aid housing as by a space-saving arrangement of the integrated electronic components. As described in the aforementioned British patent, heretofore custom-made housings were formed for each patient, conforming to that patient's auditory canal, with the electronic components of the hearing aid then being built into the otoplastic shell. This has a disadvantage, however, that a function test is only possible after the individual otoplastic shell is ready and can be placed into the ear of the patient. The built-in components can be removed or dismantled for repair or replacement only by breaking open the housing, the housing usually being glued. Additionally, a canal for venting of the volume enclosed in the auditory canal by the device must be included during manufacture of the otoplastic shell.

SUMMARY OF THE INVENTION

An object of the present invention is to construct a hearing aid of this type whose shape largely corresponds to the shape of a normal, average auditory canal.

This object is achieved by having the longitudinal axis of the tail part angled off relative to a normal line of the planar face of the head part in two mutually perpendicular longitudinal sectional planes of the housing, wherein an angle $\alpha$ between the normal line of the planar face and the longitudinal axis of the tail part lies in the range of 135°–142° in one of the longitudinal planes, preferably being 140°. An angle $\beta$ between the normal line of the planar face and the longitudinal axis of the tail part lies in the range of 12°–17° in the other of the longitudinal planes and preferably is 14°.

The largest diameter of the tail part preferably is no more than one half of the largest diameter of the head part and preferably is about ¼ to 1/5 of the largest diameter of the head part. The thinner tail part is essentially rectangular in cross-section and the head part has a planar face on which a face plate is seated, the face plate being arched round on all sides.

BRIEF DESCRIPTION OF THE DRAWINGS

Further advantages and details of the invention derive from the following description of an exemplary embodiment.

DESCRIPTION OF THE PREFERRED EMBODIMENTS

Figures 1, 2:
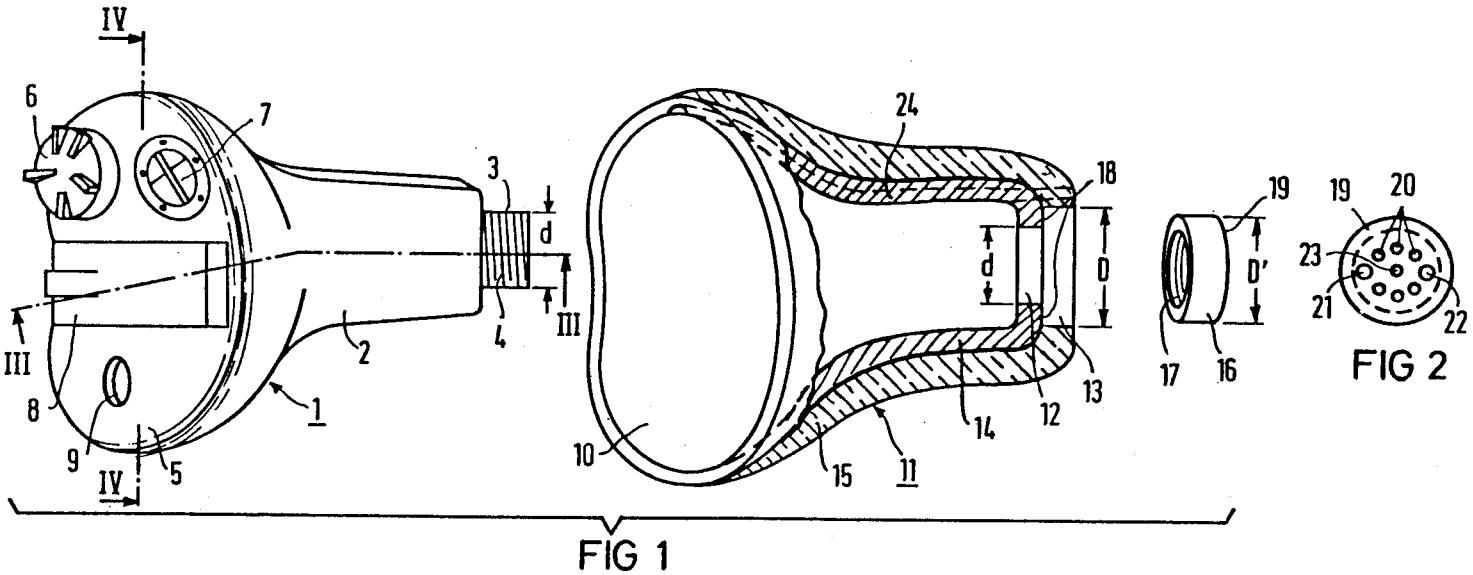
FIG. 1 is an inventive in-the-ear hearing aid comprising otoplastic shell in modular structure.
FIG. 2 is the plan view of a cerumen cover of FIG. 1.

FIG. 1 shows an in-the-ear hearing aid module 1 including a housing 2 which has a connector 3 with outside thread 4 at its proximal end. The connector 3 has a diameter d. At an arched face plate 5, the hearing aid module 1 includes an adjustment knob 6 for a volume control that can also simultaneously serve as on/-off switch for the hearing aid, a further adjustment element 7, a compartment 8 for a battery and an opening 9 for the sound supply.

The hearing aid module 1 is insertable into the hollow interior 10 of an otoplastic shell 11 so that the connector 3 projects through a first opening 12 into a second opening 13 of the otoplastic shell 11. The otoplastic shell 11 includes an over-shell 14 of transparent material, for example a polymethyl methacrylate such as acrylic PMMA, on which the actual otoplastic shell material 15 that is likewise composed of transparent material, for example likewise a polymethyl methacrylate such as acrylic PMMA, is seated. The diameter of the first opening 12 amounts to d as well or is at most only slightly larger, so that the connector is tightly seated in the first opening 12. A diameter D of the second opening 13 is larger than the diameter d of the first opening.

A cerumen cover 16 having an inside thread 17 can be screwed onto that part of the connector 3 projecting into the second opening 13. The diameter D′ of the cerumen cover is somewhat smaller (preferably 0.2 mm smaller) than the diameter D of the second opening 13. The cerumen cover can thus be comfortably screwed into the opening 13 until it strikes against an annular edge 18 of the over-shell 14. The in-the-ear hearing aid module 1 is thus seated firmly and acoustically tight in the finished otoplastic shell 11.

In accord with FIG. 2, the cerumen cover 16 has sieve-like openings 20 at its end face 19. Accordingly, it simultaneously serves the purpose of securing and positioning the module and as a cerumen trap. Further, the cerumen cover 16 also includes two through holes 21 and 22 that are arranged essentially diametrically opposite one another with respect to the center axis 23 of the cover, a screwing auxiliary or tool (not shown) having two pins engaging into these two holes 21 and 22 can be used for screwing the cover on.

A vent channel 24 is formed in the otoplastic shell 11.

Figure 3:
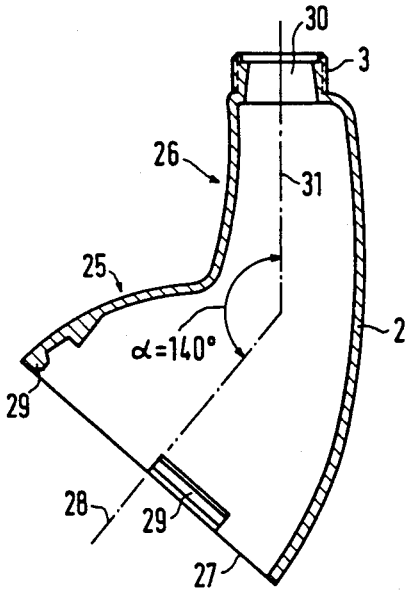
FIG. 3 is a section III—III through the housing of the hearing aid module of FIG. 1.
Figure 4:
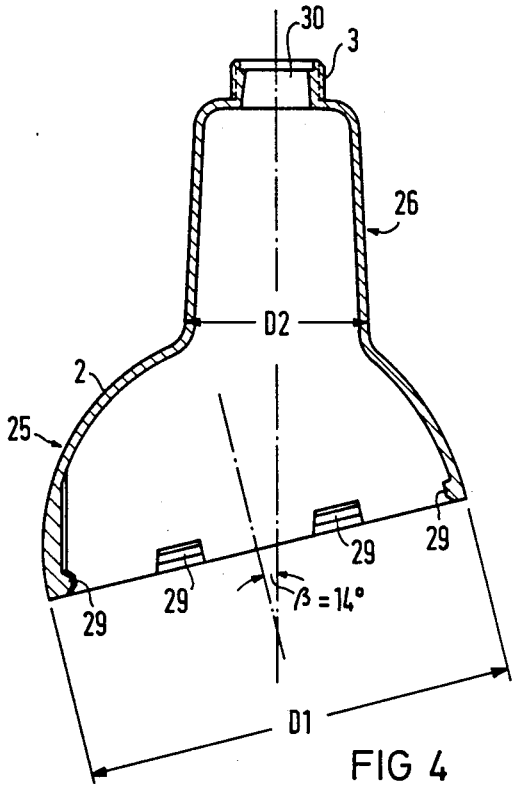
FIG. 4 is a section IV—IV through the housing of the hearing aid module of FIG. 1.

FIGS. 3 and 4 show the sections III—III and IV—IV indicated in FIG. 1 through the housing 2 of the hearing aid module when the arched face plate 5 is removed.

As may be seen from FIGS. 3 and 4 (as well as from FIG. 1), the housing 2 of the hearing aid module 1 is fashioned pear-shaped. Accordingly, it comprises a distal, bead-like head part 25 and a proximal, thinner tail part 26. A planar face of the head part 25 is indicated with 27. The planar face 27 has a normal line 28.

Figure 5:
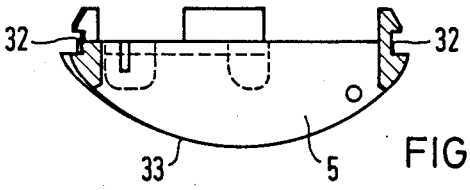
FIG. 5 is a side view of the arched face plate of the hearing aid module of FIG. 1.

Catch noses 29 are situated close to the planar face 27 for the purpose of plugging the arched face plate 5 shown separately in FIG. 5 to the planar face 27 of the housing 2 of the hearing aid module 1.

The connector 3 having a sound outlet opening 30 is located at the lowest end of the proximal, thinner tail part 26.

The longitudinal axis of the tail part 26 is referenced 31.

It may be seen from FIG. 3 that the angle $\alpha$ between the normal line 28 of the planar face 27 and the longitudinal axis 31 of the tail piece 26 amounts to $\alpha=140°$ for the longitudinal plane of section III—III.

It may be seen from FIG. 4 that the angle $\beta$ between the normal line 28 and the longitudinal axis 31 lies at $\beta=14°$ in the longitudinal plane of section IV—IV.

On the basis of this specific angling, a housing shape derives that is tailored to the average, normal auditory canal of a hearing-impaired person. This housing thus automatically fits into nearly all somewhat normally fashioned auditory canals. The reamining, individual matching now only has to be undertaken with the assistance of an otoplastic shell 11. Special adaptations of a housing to the auditory canal of an individual ear are now no longer required.

FIG. 4 also shows the greatest diameter of the planar face 27 of the housing 2, this being referenced D1. The greatest diameter of the thinner tail part 26 which is fashioned essentially rectangularly in cross section in the present case (also see FIG. 1 in this regard) is referenced D2.

The two diameters D1 and D2 are selected such that the smaller diameter D2 amounts to less than half the larger diameter D1.

In an actual embodiment, the ratio of the two diameters D1 and D2 lies at about D1:D2=2.3:1.

The proximal, thinner tail part 26 is thus considerably thinner than the distal, bead-like head part 25 of the housing 2 of the hearing aid module 1.

The otoplastic shell 11 formed of over-shell 14 and otoplastic shell material 15 can be relatively thick given these dimensions of the housing 2. This, however, enables the unproblematic, subsequent introduction of an arbitrarily shaped vent channel 24.

FIG. 5 shows the arched face plate 5 that can be put in place onto the planar face 27 of the housing 2. For fastening in the planar face 27 of the housing 2, the face plate 5 includes latch channels 32 into which catch noses 29 of the housing 1 engage. The face plate is thereby reliably held at the planar face 27 of the housing 2.

As may be seen from FIG. 5, the arc 33 of the face plate 5 is round on all sides. Corners or edges that can be cosmetically disturbing after the insertion of the finished hearing aid into the auditory canal of a hearing impaired person are thus not present.

As is apparent from the foregoing specification, the invention is susceptible of being embodied with various alterations and modifications which may differ particularly from those that have been described in the preceding specification and description. It should be understood that I wish to embody within the scope of the patent warranted hereon all such modifications as reasonably and properly come within the scope of my contribution to the art.

I claim as my invention:

1. An in-the-ear hearing aid, including a pear-shaped housing that encompasses a distal, bead-like head part having a planar face on which a face plate is seated and encompasses a proximal, thinner tail part, whereby a longitudinal axis of the tail part is angled off relative to a normal line of the planar face of the head part in two mutually perpendicular longitudinal sectional planes of the housing, comprising the improvement wherein an angle $\alpha$ between the normal line of the planar face and the longitudinal axis of the tail part lies in the range of 135°-142° in one of said longitudinal planes.

2. A hearing aid according to claim 1, wherein an angle $\beta$ between the normal line of the planar face and the longitudinal axis of the tail part lies in the range 12°-17° in the other of said longitudinal planes.

3. A hearing aid according to claim 1, wherein the angle $\alpha$ lies in the range of $140°\pm1°$.

4. A hearing aid according to claim 1, wherein the angle $\alpha$ amounts to 140°.

5. A hearing aid according to claim 2, wherein the angle $\beta$ lies in the range of $14°\pm1°$.

6. A hearing aid according to claim 2, wherein the angle $\beta$ amounts to 14°.

7. A hearing aid according to claim 1, wherein a largest diameter of the tail part is no more than one-half of a largest diameter of the head part.

8. A hearing air according to claim 7, wherein the largest diameter of the tail part amounts to about $\frac{1}{4}$ through 1/5 of the largest diameter of the head part.

9. A hearing aid according to claim 7, wherein the thinner tail part is essentially rectangular in cross section.

10. A hearing aid according to claim 1, including a head part having a planar face on which a face plate is seated, wherein the face plate is arched round on all sides.

11. An in-the-ear hearing aid comprising:

a pear-shaped housing having a distal, bead-like head part with a planar face on which a face plate is seated and having a proximal, thinner tail part;

a longitudinal axis of the tail part being disposed at an angle relative to a normal line of the planar face of the head part in two mutually perpendicular longitudinal sectional planes of the housing;

an angle $\alpha$ between the normal line of the planar face and the longitudinal axis of the tail part lying in the range 135°-142° in one of said longitudinal planes; and an angle $\beta$ between the normal line of the planar face and the longitudinal axis of the tail part lying in the range 12°-17° in the other of said longitudinal planes.

12. An in-the-ear hearing aid according to claim 11, wherein the angle $\alpha$ lies in the range of $140°\pm1°$ and the angle $\beta$ lies in the range of $14°\pm1°$.

13. An in-the-ear hearing according to claim 11, wherein the angle $\alpha$ is 140° and the angle $\beta$ is 14°.

14. An in-the-ear hearing aid according to claim 11, wherein a largest diameter of the tail part is no more than one half of a largest diameter of the head part.

15. An in-the-ear hearing aid according to claim 14, wherein the largest diameter of the tail part is in the range of 1/5 to $\frac{1}{4}$ of the largest diameter of the head part.

16. An in-the-ear hearing aid according to claim 14, wherein the thinner tail part is essentially rectangular in cross section.

17. An in-the-ear hearing aid according to claim 11, including a head part having a planar face on which a face plate is seated, wherein the face plate is arched round on all sides.

* * * * *